United States Patent [19]

Cugini

[11] 4,154,302

[45] May 15, 1979

[54] CABLE FEED-THROUGH METHOD AND APPARATUS FOR WELL HEAD CONSTRUCTIONS

[75] Inventor: Edward T. Cugini, Brea, Calif.

[73] Assignee: Shafco Industries, Inc., Buena Park, Calif.

[21] Appl. No.: 847,248

[22] Filed: Oct. 31, 1977

[51] Int. Cl.[2] ..... E21B 33/03

[52] U.S. Cl. ..... 166/315; 166/65 R; 166/88; 339/94 M

[58] Field of Search ..... 339/94 R, 94 A, 94 M; 166/315, 65 R, 88

[56] References Cited

U.S. PATENT DOCUMENTS

| | | | |
|---|---|---|---|
| 3,437,149 | 4/1969 | Cugini et al. | 166/88 X |
| 3,803,531 | 4/1974 | Sorensen | 339/94 A |
| 3,986,765 | 10/1976 | Shaffer | 331/94 A |
| 4,053,196 | 10/1977 | Dunaway | 339/94 R |
| 4,085,993 | 4/1978 | Cairns | 339/94 M |

*Primary Examiner*—William Pate, III

*Attorney, Agent, or Firm*—Poms, Smith, Lande, Glenny & Rose

[57] ABSTRACT

An improved cable feed-through apparatus and method for wellheads including a unitary shell having a plurality of knock-down components therein. A plurality of parallel spaced conductors are inserted through rigid spacing and compression rings with upper and lower exposed ends for providing coupling to electric feed cables. The conductors are insulated throughout by resilient sleeves which are removably mounted in the shell. When assembled, as the shell is threaded into a hanger of a well casing head, the resilient sleeves are compressed and forced together to form a pressure-tight, insulated cable feed through device.

11 Claims, 6 Drawing Figures

Fig. 2.
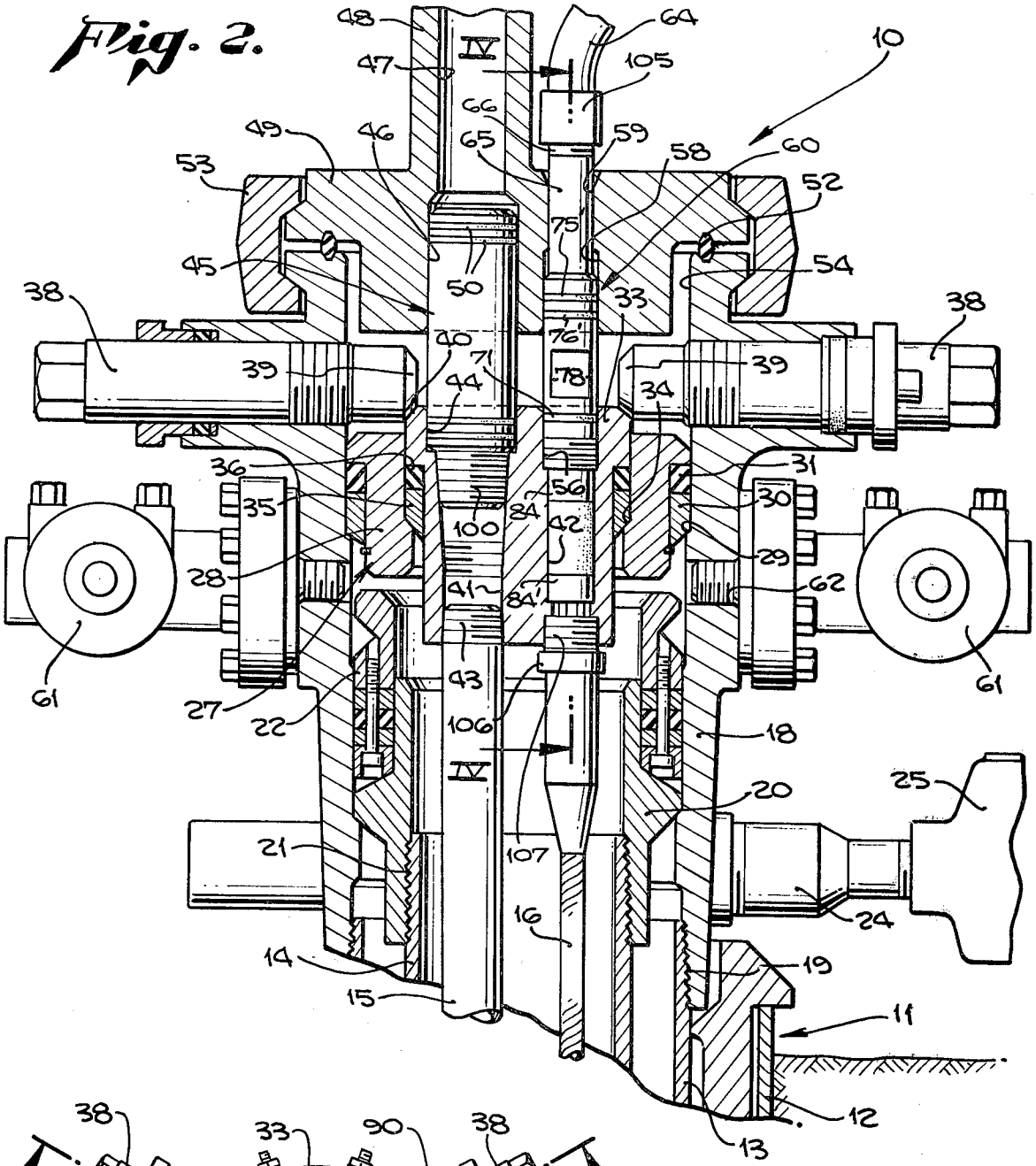
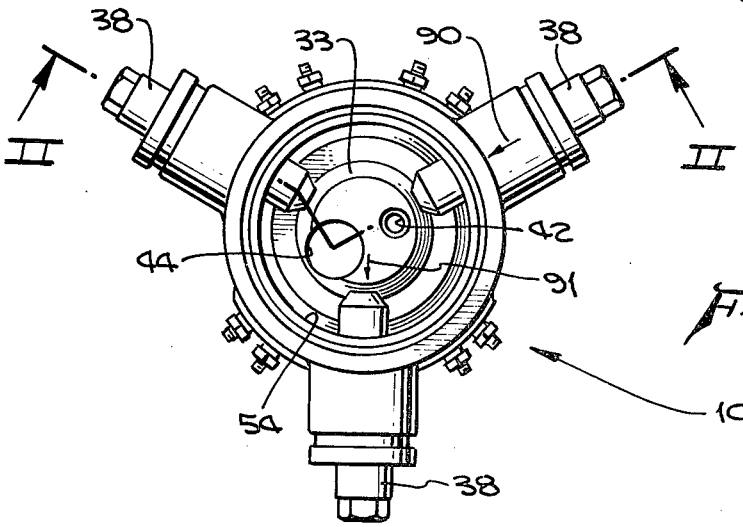
Fig. 1.

CABLE FEED-THROUGH METHOD AND APPARATUS FOR WELL HEAD CONSTRUCTIONS

BACKGROUND OF THE INVENTION

1. Field of the Invention

The invention relates to wellhead constructions; and, more particularly, to an improved cable feed-through device for use in a well head.

2. Description of the Prior Art

Various arrangements are known in the art for passing electrical cable through a well head to the interior of a well head casing. In U.S. Pat. No. 3,437,149 to Cugini et al, a pressure resistant cable feed-through means is disclosed extending from outside a well head construction to within a well casing and passing through a pressure zone in the well head. Coupling means are provided at opposite ends of the cable feed-through means and conductors embedded in a dielectric material are molded within and protected by a rigid metal casing or shell. The feed-through means facilitates assembly of a well head and may be carried by hanger means adapted to be passed through a blow-out preventer.

The cable feed-through means of Cugini et al is molded as one complete unit and the entire unit must be replaced when such means wears out and/or breaks down.

In prior art cable feed-through devices, before Cugini et al, the conductor wires of the cable feed-through device were pushed together in use which tend to change their dielectric centers. This caused shorts and raised the possibility of electrocution of the operator. Further, gases escaped around the conductor wires and thus such means could not hold the well head pressure.

The advantages of the Cugini et al cable feed-through means reside primarily in the fact that, since it is molded as one unit, the dielectric centers of the conductor wires do not change. However, since it is a single molded unit. it must be tested prior to use in the field. Also, since it does not lend itself to variations in length, a significant number of differing lengths msut be kept in inventory. In case of breakdown, the entire unit must be replaced. There is thus a need for a cable feed-through means which retains the advantages of the cable feed-through means of Cugini et al but reduces the number of such devices which must be kept in inventory, permits quick and easy replacement at the well, and eliminates the need for pre-testing.

SUMMARY OF THE INVENTION

It is an object of this invention to provide an improved cable feed-through means for a well head construction which facilitates assembly and installation of a well head under blow-out preventer conditions.

It is a further object of this invention to provide an improved cable feed-through means wherein electrical conductors and insulation therearound are protected from well pressures, well conditions and well testing pressures.

It is still another object of this invention to provide a cable feed-through means comprised of a plurality of knockdown components, any of which can be quickly and easily replaced in the field, and which includes electrical conductors and insulation thereof which may be quickly and easily cut to any desired length.

These and other objects are preferably accomplished by providing a unitary shell having a plurality of knockdown components therein. A plurality of parallel spaced conductors are inserted through rigid spacing and compression rings with upper and lower exposed ends for providing coupling to electric feed cables. The conductors are insulated throughout by resilient sleeves which are removably mounted in the shell. When assembled, as the shell is threaded into a hanger of a well casing head, the resilient sleeves are compressed and forced together to form a pressure-tight, insulated cable feed through device.

BRIEF DESCRIPTION OF THE DRAWING

FIG. 1 is a top plan view of a well head apparatus embodying this invention with a sealing flange removed;

FIG. 2 is an enlarged fragmentary sectional view of the well head apparatus shown in FIG. 1, the sectional view being taken in the vertical plane indicated by line II—II of FIG. 1;

DESCRIPTION OF THE PREFERRED EMBODIMENT

Figure 3:
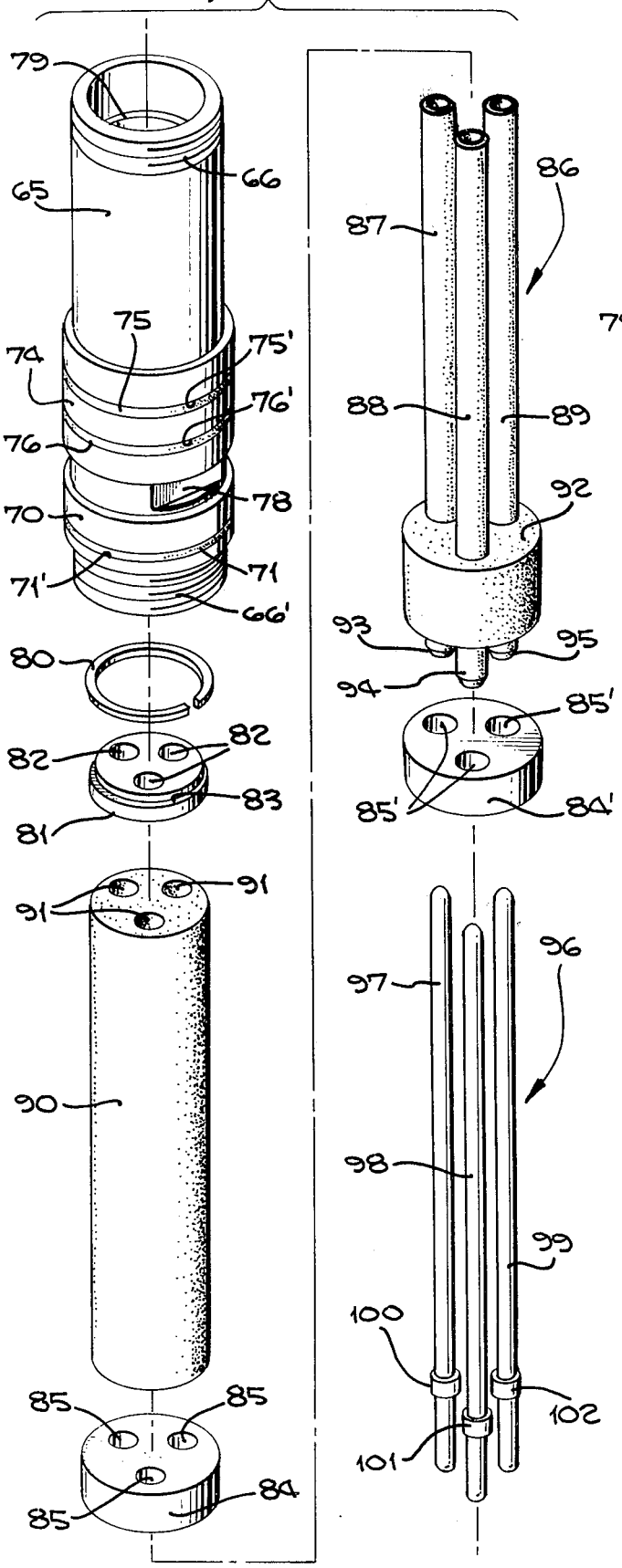
FIG. 3 is an exploded view of a cable feed-through means embodying this invention.

In FIGS. 1 & 2 of the drawing, a well head apparatus generally indicated at 10 embodying this invention may be associated wtih a casing means 11 which extends into a well hole and is of well-known construction and arrangement. In this example, within an outer pipe 12 may be concentrically arranged an intermediate casing 13 and an inner casing 14. Inner casing 14 may receive in spaced relation a production tubing 15 and an electric power cable 16. The production tubing 15 may extend into the well for passage therethrough of well fluids such as oil, water, etc. The power cable 16 extends into the well for connection with various types of electrically actuated devices adapted for use within the casing means and the well.

In general, well head apparatus 10 may comprise a casing head means 18 having a threaded connection at 19 to the upper end of intermediate casing 13. Within the lower portion of casing head 18, a mandrel body 20 is threaded as at 21 to the upper end of inner casing 14. A replaceable packing unit 22 provides a seal between the upper portion of mandrel body 20 and the opposed inner surface of casing head 18. Below the replaceable packing unit 22 is thus formed an annular zone between the inner casing 14 and the intermediate casing 13 to which communication may be provided by a suitable nipple 24 on the casing head and an associated valve means 25.

Above mandrel body 20, hanger means are provided for supporting production tubing string 15 and electrical cable 16 which extend into the well casing. The hanger assembly generally indicated at 27 may comprise a primary hanger body 28 landed on an inwardly and downwardly tapered annular surface 29 through an annular gland means 30 which includes a seal ring 31. Within the primary hanger body 28 may be landed a tubing hanger body or support means 33 through a tapered inwardly annularly inclined landing surface 34 on the primary hanger body and a packing gland means 35 which includes a seal ring 36. Locking screws 38 in circumferential spaced relation about casing head 18 provide beveled ends 39 for wedge engagement with a beveled surface 40 on top of tubing hanger body 33 for securing the tubing hanger body and the primary hanger body 28 in assembled relationship with the casing head 18.

The tubing hanger body 33 may extend below the primary hanger body 28 and partially into the mandrel body 20. Hanger body 33 may be provided with a pair of throughbores 41 and 42 having axes lying in a plane offset from the geometric axis of the tubing hanger body 33. Throughbore 41 may be provided with a bottom threaded connection as at 43 to the upper end of production tubing string 15. Above threaded connection 43, threads 100 provide a connection to a suitable back pressure valve (not shown) which may be installed in the tubing hanger for and during landing thereof and then later removed for a production operation as later described. The upper end of throughbore 41 may be slightly enlarged to provide a socket at 44 for reception of the lower end of a spacer pipe 45. The upper end of spacer pipe 45 may be received in an enlarged socket 46 provided at the lower end of a bore 47 formed in upstanding hub 48 of seal flange 49. Packing means 50 seals the ends of spacer pipe 45 in the sockets 44, 46.

The seal flange 49 covers and closes the top of casing head 18. Between opposed peripheral marginal faces of seal flange 49 and of casing head 18 is mounted a gasket ring 52 which may be suitable compressed by well-known annular clamp means 53. Seal flange 49 and the hanger means 27 including the primary hanger and tubing hanger define a well head pressure test zone 54.

Suitable valve means 61 may be carried by casing head 18 and provided communication through a port 62 with pressure test zone 54 and the inner casing 14 through the circulating mandrel body 20. Suitable testing ports for the several zones in the casing head may be provided in well-known manner and are not shown.

Throughbore 42 of tubing hanger 33 is provided with an upwardly facing enlarged threaded socket 56. Seal flange 49 is provided with a downwarkly facing enlarged socket 58 and an opening 59 both of which are axially aligned with the axis of throughbore 42.

As particularly contemplated in the present invention, improved cable feed-through means 60 are provided for providing a rapid facile connection to cable 16 during assembly of the well head construction while maintaining blow-out prevention. In the exemplary embodiment of the invention, such means 60, which, when assembled, extends below tubing hanger 33 and into mandrel body 20, through pressure zone 54 above tubing head 33, and through opening 59 for connection above the seal flange 49 with feed cable means 64, includes an elongated rigid tubular hollow housing or shell 65 (FIG. 3), which may be made of suitable metal material such as steel. Shell 65 is provided with upper and lower threaded ends 66, 66[1], adapted to be coupled to suitable pressure-type couplings 105 and 106 (see FIG. 4) for securing and protecting under pressure conditions electrical cable connections to conductors of the feed-through means 60. Shell 65 includes an enlarged external annular portion 70 having at least one annular groove 71[1] for receiving a sealing or packing ring 71 (see FIG. 4) therein. This portion 70 and its ring 71 is received within socket 56 of tubing hanger 33 when shell 65 is threaded into threaded socket 57 and provides a pressure seal of the cable feed-through device 60 with tubing hanger 33.

Spaced from enlarged portion 70 a preselected distance, shell 65 includes a second enlarged annular portion 74 provided with preferably a pair of space grooves 75, 76 which receive seal rings 75[1], 76[1] (see FIG. 4) therein. Enlarged portion 74 and rings 75[1], 76[1] are received within socket 58 of sealing flange 49 to provide a pressure seal therewith when sealing flange 49 is assembled with casing head 18.

The exterior of shell 65 is provided with flats 78 for receiving a tool thereon (not shown) for tightening the same when assembled, as will be discussed.

The upper end of the interior of shell 65 has a groove 79 for receiving a snap ring or retainer 80 therein. A metallic spacer ring 81 is provided having a plurality of apertures 82 therethrough, such as three apertures. When assembled into shell 65, ring 80 enters groove 79 and the shoulder 83 on ring 81 abuts against ring 80 to prevent upward movement. A compression ring 84, also of metal and having a like number of apertures 85 therein, aligned with apertures 82, is provided below guide 90. An insulation sleeve assembly 86, having a plurality of insulation sleeves, such as sleeves 87 through 89, is provided below ring 84 with sleeves 87 through 89 being aligned with apertures 82, 85 and adapted to be inserted therethrough. A resilient centering guide 90, having a plurality, such as three, of apertures 91 therethrough, is provided for receiving sleeves 87 through 89 in apertures 91. Guide 90 keeps sleeves 87 through 89 properly centered within sleeve 65. A pack off ring 84[1], similar to rings 81 and 84, with apertures 85[1], is also provided as will be discussed. A resilient compression pack off sleeve 92 is provided in assembly 86 having sleeves 87 through 89 extending upwardly therefrom and includes a plurality, such as three, of downwardly extending sleeves 93 through 95. A conductor assembly 96 is provided comprised of a plurality of elongated electrical conductors, such as three- i.e., wires 97, 98, and 99, which are adapted to be inserted through apertures 85[1], 93–95 and 87–89, through apertures 85, 91 and 82 and end at the top of shell 65, as will be discussed in FIG. 4. Each conductor 97 through 99 may have a shoulder, as shoulders 100 through 102, respectively, thereon for providing a stop for the conductors for reasons to be discussed.

The various rings, flanges, and O-rings and the like provide pressure seals for the cable feed-through means 60 as is well known in the art. Conductors 97 through 99 may be solid copper of a selected gauge and embedded in the resilient sleeves 87 through 89 and 93 through 95. Any suitable resilient dielectric material may be used that has the characteristics of rigidity, hardness, toughness, and chemical resistance desired.

The cable feed-through means 60 is assembled by inserting conductors 97 through 99 into sleeves 87 through 89 and then sleeves 87 through 89 through apertures 91 in sleeve 90. The upper ends of conductors 97 through 99 are passed through apertures 85 and 82 in rings 84 and 81 with snap ring 80 snapped into groove 79 and shoulder 83 of ring 81 abutting against snap ring 80. Ring 84 is disposed adjacent threaded end 66[1] until final assembly.

Figure 5:
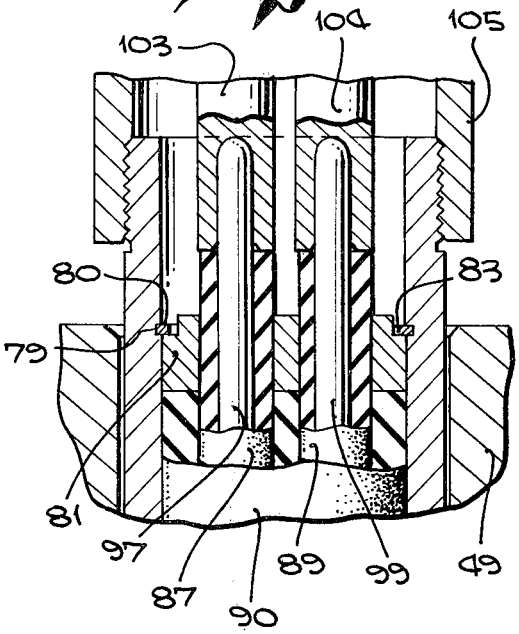
FIG. 5 is a detailed cross-sectional view of a portion of the means of FIG. 4.
Figure 4:
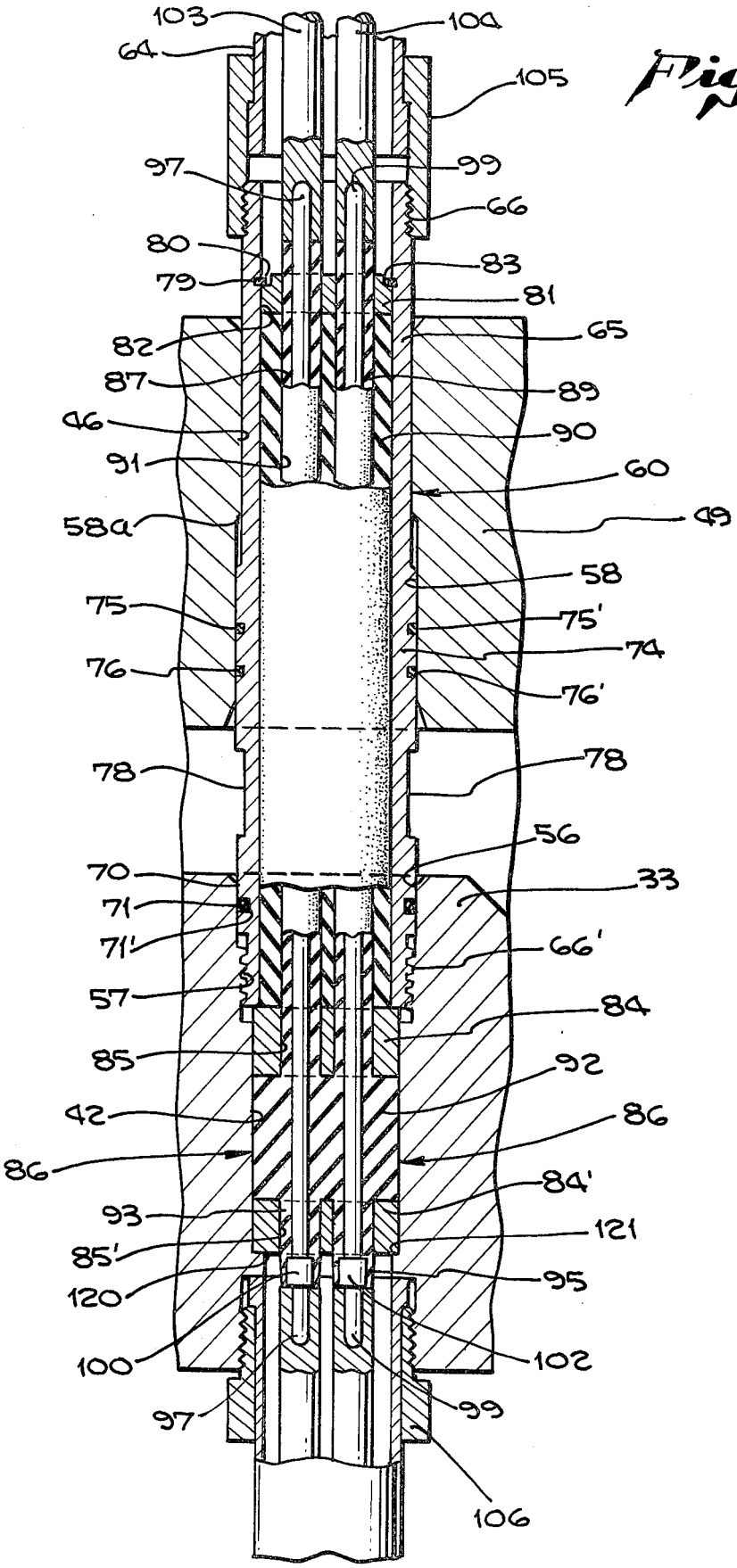
FIG. 4 is an assembled view of the cable feed-through means of FIG. 3 installed in the apparatus of FIGS. 1 & 2 or similar-type apparatus taken along lines IV—IV of FIG. 2.

The completed assembly of means 60 is shown in FIG. 4 assembled in the well head structure of FIG. 1. It can be seen that the resilient material surrounds the conductors. Only the terminal ends of the conductors at the top and bottom of shell 65 are not embedded in or surrounded by resilient material. These projecting ends engage contact prongs 103 and 104, respectively, which are coupled to couplings 105, 106, respectively. Couplings 105, 106 may be pressure-type of suitable manfacture and readily electrically engagable with prongs 103 and 104 (see also FIG. 5 for upper coupling 105). The resilient material surrounding the conductors 97 through 99, when assembled, substantially minimizes pressure through cable feed-through means 60 and virtually eliminates them. Conductor 99 and its coupling is not visible in (FIG. 4).

In the embodiment described above, the tubing hanger may be prepared for installation by connecting a production string 15 thereto. A back pressure valve may be installed in bore 41; other typed of pressure holding devices may be used in the production string or well if desired. Feedthrough means 60 may then be threadably connected at 56 via threaded end 66$^1$ to the tubing hanger with packing 71$^1$ in tight sealing engagement with socket 56 in the hanger. The bottom end of feedthrough means 60 extends into hanger 33 ending above ring 84$^1$ with the sleeve 92 abutting against the upper surface of ring 84$^1$ (FIG. 4). When threaded end 66$^1$ is threaded into threaded portion 56 of tubing hanger 33, the entire assembly is forced or compressed together so that the resilient material of sleeves 87 through 89 and 93 through 95 and ring 92, compresses and "flows" into the spacings about conductors 87 through 89. This also compresses the resilient material at 92 to fill the area between ring 84 and 84$^1$ to form a pressure tight seal in hanger 33. Lower coupling 106 may have a threaded collar 107 for coupling the same into a threaded portion of the lowermost portion of casing hanger 33 and cable 16 is coupled to coupling 106. Ring 84$^1$, as seen in FIG. 4, provides a shoulder 120 which engages a flange 121 on hanger 33 to provide a stop for means 60.

When tubing 15, the back pressure valve (not shown), and feed-through means 60, and connector 106 are in assembly with the tubing hanger 33, the hanger 33 may be landed through a blow-out preventor (not shown) on the primary hanger 33. The upper portion of feed-through means 60 extends above the tubing hanger. Upon lowering of a seal flange 49 over the casing head, the upper packings 75$^1$, 76$^1$ are sealingly engaged in socket 58 in the seal flange and assembly thereof completed.

It should be noted that in the event well pressures cause release or breaking of the threaded connection at 57 of the feed-through means 60 with the hanger 33, the shoulder 58*a* formed on sealing flange 49 at the bottom of socket 58 wil1 serve as a stop means to prevent disassembly of the feed through means 60 with the sealing flange and well head.

To facilitate such installation where the feed cable includes a bent or curved portion above seal flange 49, index or reference marks 90 and 91 (FIG. 1) may be provided respectively on the upper portion of the casing head and on the tubing head. Alignment of the marks 90, 91 locates the feed-through means for easy coupling to a feed cable 64.

It will be readily apparent to those skilled in the art that the cable feed-through means facilitates speed of installation of a tubing head means with an electrical connection therethrough. Provision of pressure-tight electrical coupling connectors at ends of the rigid shell provide further protection against pressure leaks through the cable connection.

When it is desirable to pressure test the well head construction, the internal well pressures are resisted by steel shell 65 and the effect of pressure at ends of the steel shell and upon the dielectric material is substantially eliminated and minimized.

The invention contemplates that the conductor feed-through for the tubing hanger be protected by a metal pressure shell which facilitates assembly of a well head and which prevents damage, mutilation, deterioration and bread down of the dielectric material under pressure, test, and operating conditions found in a well head installation.

While exemplary dielectric material as epoxy and neoprene have been described, other types of pressure and chemical resistant dielectric material may be used, such as glass and synthetic plastic compositions which will prevent interior leakage along the interfaces of the metal and dielectric material.

Figure 6:
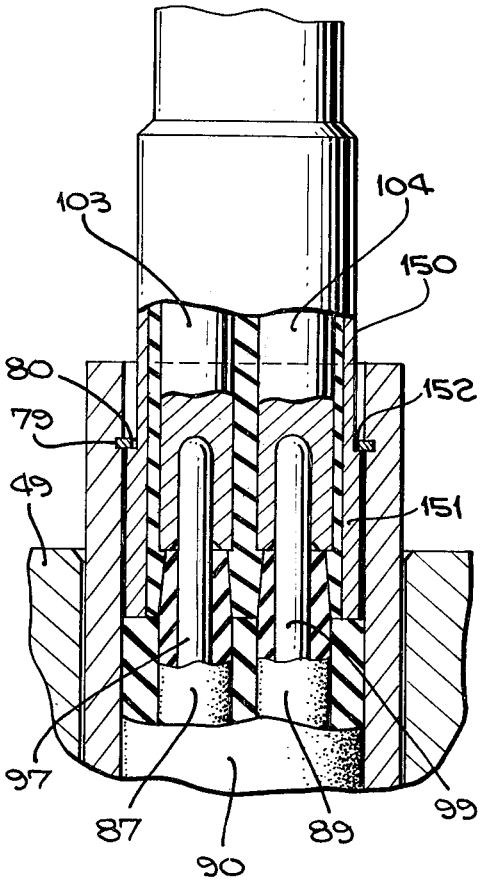
FIG. 6 is a cross-sectional view of a portion of the apparatus of FIG. 4 similar to the view shown in FIG. 5 showing a modification thereof.

FIG. 6 shows a modification of the upper coupling. This coupling 150 has a metallic outer sleeve 151 with a shoulder 152 thereon which abuts against snap ring 80, the remaining parts of this embodiment being otherwise identical to that of FIGS. 1 through 4. Sleeve 151 replaces ring 81 of the FIG. 3 embodiment. That is, ring 80 is provided on the sleeve 151 on coupling 150 and snapped down into groove 79 to prevent easy withdrawal of coupling 150 from disengagement with prongs 103, 104. This acts as a safety feature for the feed through means so that it cannot be easily disconnected.

By making cable feed-through means 60 of knock-down components which may be quickly and easily assembled when desired, parts replacement can be quickly made in the field. The conductors are sealed and their centers remian in alignment. Sleeves 87 through 89 can be made af any desired length and cut to size, when required, thus eliminating the need for a large inventory of various sized cable feed through means.

I claim:

1. In a well head apparatus including a casing head means, hanger means supported from the casing head means, a sealing means for said casing head means spaced above said hanger means and defining therein a pressure zone, means providing a throughbore in both the hanger means and the sealing means, a cable feed-through means carried by said throughbores, said cable feed-through means having cable coupling means at opposite ends thereof below said hanger means and above said sealing means, the improvement which comprises:

said cable feed-through means being comprised of a plurality of knock-down components, said components including a shell having upper and lower threaded ends for coupling said shell to both said sealing means and said hanger means, a plurality of spaced parallel conductors removably mounted internally of said shell, rigid spacing means encircling said conductors removably mounted in said shell maintaining said conductors in a preselected spaced parallel relationship, said conductors having upper and lower exposed terminal portions forming said cable coupling means, and resilient means removably mounted in said shell in continuous relationship with all of said conductors except for said exposed terminal portions, said spacing means including a spacing ring of rigid material having apertures therein for receiving said upper terminal portions therethrough, a first compression ring abutting against the lower threaded end of said shell having a plurality of apertures therein receiving said conductors therethrough, said compression means abutting against a first portion of said resilient means for compressing the same when said lower threaded end of said shell is threaded into said hanger means, said resilient means further including a resilient compression pack off ring having a second portion of said resilient means extending above and below said compression pack off ring, and a second rigid compression ring below said resilient compression pack off ring having a plurality of apertures therein receiving the portion of said second portion of said resilient means extending below said compression pack off ring, the lower exposed terminal portions of said conductors extending through the portion of said second portion below said second compression ring, the apertures in said first and second compression ring, said spacing ring and said compression pack off ring being axially aligned, the first portion of said resilient means including a resilient sleeve having a plurality of apertures therein axially aligned with the apertures of both said compression rings, said spacing ring and said compression pack off ring, said second resilient portion including a plurality of resilient tubular sleeves extending from said resilient compression pack off ring, said tubular sleeves passing through said apertures in said first-mentioned resilient sleeve and receiving said conductors therethrough, said shell including a snap ring removably mounted in a groove on the inner wall of said shell adjacent the upper threaded end, said spacing ring having a shoulder thereon abutting against said snap ring.

2. In the apparatus of claim 1 wherein said conductors have shoulders thereon adjacent the lower terminal ends thereof, said conductor shoulders being disposed below said second compression ring.

3. In a well head apparatus including a casing head means, hanger means supported from the casing head means, a sealing means for said casing head means spaced above said hanger means and defining therein a pressure zone, means providing a throughbore in both the hanger means and the sealing means, a cable feed-through means carried by said throughbores, said cable feedthrough means having a cable coupling means at opposite ends thereof below said hanger means and above said sealing means, the improvement which comprises:

said cable feed-through means being comprised of a plurality of knock-down components, said components including a shell having upper and lower threaded ends for coupling said shell to both said sealing means and said hanger means, a plurality of spaced parallel conductors removably mounted internally of said shell, rigid spacing means encircling said conductors removably mounted in said shell maintaining said conductors in a preselected spaced parallel relationship, said conductors having upper and lower exposed terminal portions forming said cable coupling means, and resilient means removably mounted in said shell in continuous relationship with all of said conductors except for said exposed terminal portions, said shell including an elongated hollow tubular pressure shell of metal and including a shoulder on the exterior thereof between said upper and lower threaded ends, said sealing means having an enlarged chamber therein with a shoulder adapted to engage the shoulder on said shell for limiting the upward movement of said shell, at least one groove adapted to receive a resilient sealing ring on the outer surface of said shell below said shoulder on said shell, a plurality of flat portions on the exterior of said shell below said groove on said shell, and a second shoulder on the exterior of said shell above the lower threaded end thereto for receiving a second resilient sealing ring therein.

4. A cable feed-through means for use in a well head apparatus including a pressure zone comprising:

a plurality of knock-down components, said components including a shell having upper and lower threaded ends for coupling said shell to both said sealing means and said hanger means, a plurality of spaced parallel conductors removably mounted internally of said shell, rigid spacing means encircling said conductors removably mounted in said shell maintaining said conductors in a preselected spaced parallel relationship, said conductors having upper and lower exposed terminal portions forming said cable coupling means, and resilient means removably mounted in said shell in continuous relationship with all of said conductors except for said exposed terminal portions, said spacing means including a spacing ring of rigid material having apertures therein for receiving said upper terminal portions therethrough, a first compression ring abutting against the lower threaded end of said shell having a plurality of apertures therein receiving said conductor therethrough, said compression ring abutting against a first portion of said resilient means for compressing the same when said lower threaded end of said shell is threaded into said hanger means, said resilient means further including a resilient compression pack off ring having a second portion of said resilient means extending above and below said compression pack off ring, and a second compression ring below said compression pack off ring having a plurality of apertures therein receiving the portion of said second portion of said resilient means extending below said compression pack off ring, the lower exposed terminal portions of said conductors extending through the portion of said second portion below said second compression ring, the apertures in said first and second compression rings, said spacing ring and said compression pack off ring being axially aligned.

5. In the apparatus of claim 4 wherein the first portion of said resilient means includes a resilient sleeve having a plurality of apertures therein axially aligned with the apertures of both of said compression rings, said spacing ring and said compression pack off ring, said second resilient portion including a plurality of resilient tubular sleeves extending from said compression pack off ring, said tubular sleeves passing through said apertures in said first-mentioned resilient sleeve and receiving said conductors therethrough.

6. In the apparatus of claim 5 wherein said shell includes a snap ring removably mounted in a groove on the inner wall of said shell adjacent the upper threaded end, said spacing ring having a shoulder thereon abutting against said snap ring.

7. In the apparatus of claim 6 wherein said conductors have shoulders thereon adjacent the lower terminal ends thereof, said conductor shoulders being disposed below said second compression ring.

8. A cable feed-through means for use in a well head apparatus including a pressure zone comprising:

a plurality of knock-down components, said components including a shell having upper and lower threaded ends for coupling said shell to both said sealing means and said hanger means, a plurality of spaced parallel conductors removably mounted internally of said shell, rigid spacing means encircling said conductors removably mounted in said shell maintaining said conductors in a preselected spaced parallel relationship, said conductors having upper and lower exposed terminal portions forming said cable coupling means, and resilient means removably mounted in said shell in continuous relationship with all of said conductors except for said exposed terminal portions, said shell including an elongated hollow tubular pressure shell of metal and including a shoulder on the exterior thereof between said upper and lower threaded ends, said sealing means having an enlarged chamber therein with a shoulder adapted to engage the shoulder on said shell for limiting the upward movement of said shell, at least one groove adapted to receive a resilient sealing ring on the outer surface of said shell below said shoulder on said shell, a plurality of flat portions on the exterior of said shell below said groove on said shell, and a second shoulder on the exterior of said shell above the lower threaded end thereto for receiving a second resilient ring therein.

9. In a method of installing an electrical power feed in a well head, said well head including a casing head and a hanger means, the improvement comprising the steps of:

inserting a plurality of parallel spaced electrical conductors through a like plurality of resilient tubular sleeves extending above and below a resilient compression pack off ring;

inserting said conductors in the portion of said tubular resilient sleeves below said compression pack off ring through a first compression ring until exposed ends of said conductors extend below said first compression ring;

inserting a snap ring into an internal groove on the inner wall of a hollow tubular metallic shell having upper and lower threaded ends, said groove being adjacent said upper threaded end;

inserting said plurality of conductors within said tubular sleeves through a plurality of aligned apertures in a second rigid compression ring;

inserting said plurality of tubular resilient sleeves above said compression pack off ring through a plurality of aligned apertures in a resilient sleeve until exposed ends of said conductors extend above said resilient sleeve;

inserting the upper ends of said tubular sleeves through a plurality of aligned apertures in a rigid spacing ring having a shoulder thereon until exposed ends of said conductors extends above said rigid spacing ring;

inserting said rigid spacing ring into said shell until said shoulder abuts against said snap ring; and threading said lower threaded end of said shell into a threaded socket in said hanger means with said lower threaded end abutting against said second rigid compression ring with the latter abutting against the upper surface of said compression pack off ring thereby forcing all of the internal components of said shell together and compressing the resilient material of said sleeves and said pack off ring to provide electrical insulation throughout said shell to said conductors and maintain said conductors in said spaced parallel relationship.

10. In the method of claim 9 including the step of coupling electric feed cables to the upper and lower exposed ends of said conductors.

11. In the method of claim 9 including the step of cutting said tubular sleeves and said resilient sleeve to a predetermined length prior to inserting said conductors into said tubular sleeves.

* * * * *